US010260357B2

(12) United States Patent
Oikawa et al.

(10) Patent No.: US 10,260,357 B2
(45) Date of Patent: Apr. 16, 2019

(54) STEAM TURBINE ROTOR, STEAM TURBINE INCLUDING SAME, AND THERMAL POWER PLANT USING SAME

(71) Applicant: Mitsubishi Hitachi Power Systems, Ltd., Nishi-ku, Yokohama (JP)

(72) Inventors: Shinji Oikawa, Yokohama (JP); Shinya Imano, Yokohama (JP); Hiroyuki Doi, Yokohama (JP); Akira Yoshinari, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 515 days.

(21) Appl. No.: 14/971,462

(22) Filed: Dec. 16, 2015

(65) Prior Publication Data

US 2016/0177742 A1 Jun. 23, 2016

(30) Foreign Application Priority Data

Dec. 17, 2014 (JP) ..... 2014-254972

(51) Int. Cl.
*F01D 5/28* (2006.01)
*C22C 14/00* (2006.01)
(Continued)

(52) U.S. Cl.
CPC ..... *F01D 5/28* (2013.01); *C22C 14/00* (2013.01); *C22C 38/001* (2013.01); *C22C 38/002* (2013.01); *C22C 38/04* (2013.01); *C22C 38/44* (2013.01); *C22C 38/46* (2013.01); *C22C 38/48* (2013.01); *C22C 38/52* (2013.01);
(Continued)

(58) Field of Classification Search
None
See application file for complete search history.

(56) References Cited

U.S. PATENT DOCUMENTS 4,917,738 A 4/1990 Takano et al.
5,061,440 A 10/1991 Watanabe et al.
(Continued)

FOREIGN PATENT DOCUMENTS

CN 1024927 C 6/1994
CN 103722108 A 4/2014
(Continued)

OTHER PUBLICATIONS

Chinese Office Action issued in counterpart Chinese Application No. 201510943892.3 dated Oct. 8, 2016 with partial English-language translation (eleven (11) pages).
(Continued)

*Primary Examiner* — Daniel J. Schleis
(74) *Attorney, Agent, or Firm* — Crowell & Moring LLP

(57) ABSTRACT

It is an objective of the invention to provide a steam turbine rotor of which a rotor shaft is made of a low-cost heat resistant ferritic steel and that can withstand high main steam temperatures of about 650° C. There is provided a steam turbine rotor comprising: a rotor shaft made of a heat resistant ferritic steel such as a 12-Cr steel; and a rotor blade made of a Ti—Al alloy, wherein the Ti—Al alloy includes: from 38 to 45 atomic % of Al; from 0.5 to 2 atomic % of V; from 2 to 6 atomic % of Cr and/or Mo; and the balance being Ti and incidental impurities.

6 Claims, 3 Drawing Sheets

(51) Int. Cl.

| | |
|---|---|
| ***C22C 38/04*** | (2006.01) |
| ***C22C 38/44*** | (2006.01) |
| ***C22C 38/46*** | (2006.01) |
| ***C22C 38/48*** | (2006.01) |
| ***C22C 38/52*** | (2006.01) |
| ***C22C 38/54*** | (2006.01) |
| ***F01D 5/02*** | (2006.01) |
| ***F01D 5/06*** | (2006.01) |
| ***F01D 25/00*** | (2006.01) |
| ***C22C 38/00*** | (2006.01) |

(52) U.S. Cl.

CPC ..... *C22C 38/54* (2013.01); *F01D 5/02* (2013.01); *F01D 5/06* (2013.01); *F01D 25/005* (2013.01); *F05D 2220/31* (2013.01); *F05D 2220/72* (2013.01); *F05D 2240/60* (2013.01); *F05D 2300/11* (2013.01); *F05D 2300/121* (2013.01); *F05D 2300/13* (2013.01); *F05D 2300/131* (2013.01); *F05D 2300/132* (2013.01); *F05D 2300/171* (2013.01); *F05D 2300/174* (2013.01)

(56) References Cited

U.S. PATENT DOCUMENTS

| | | | | |
|---|---|---|---|---|
| 5,296,056 | A | 3/1994 | Jain et al. | |
| 5,372,662 | A | 12/1994 | Ganesan et al. | |
| 5,417,781 | A * | 5/1995 | McQuay | C22C 14/00 148/421 |
| 5,591,391 | A * | 1/1997 | Igarashi | C22C 38/22 420/37 |
| 5,626,817 | A | 5/1997 | Sawaragi et al. | |
| 7,820,098 | B2 * | 10/2010 | Morinaga | C22C 38/001 420/107 |
| 2004/0060621 | A1 * | 4/2004 | Fujitsuna | C21D 1/18 148/609 |
| 2008/0112837 | A1 * | 5/2008 | Yoshizawa | C22C 38/02 420/38 |

FOREIGN PATENT DOCUMENTS

| | | | |
|---|---|---|---|
| CN | 103789598 | A | 5/2014 |
| CN | 103820676 | A | 5/2014 |
| CN | 103924121 | A | 7/2014 |
| EP | 0 469 525 | A1 | 2/1992 |
| EP | 0 521 516 | A1 | 1/1993 |
| EP | 0816007 | * | 1/1998 |
| EP | 0 976 844 | A2 | 2/2000 |
| EP | 1 770 182 | A1 | 4/2007 |
| EP | 2 620 517 | A1 | 7/2013 |
| JP | 62-103345 | A | 5/1987 |
| JP | 7-150277 | A | 6/1995 |
| JP | 8-13102 | A | 1/1996 |
| JP | 8-30251 | B2 | 3/1996 |
| JP | 9-59746 | A | 3/1997 |
| JP | 2003-269106 | A | 9/2003 |
| JP | 2012-219682 | A | 11/2012 |

OTHER PUBLICATIONS

Extended European Search Report issued in counterpart European Application No. 15198031.5 dated May 12, 2016 (eleven (11) pages).

* cited by examiner

STEAM TURBINE ROTOR, STEAM TURBINE INCLUDING SAME, AND THERMAL POWER PLANT USING SAME

CLAIM OF PRIORITY

The present application claims priority from Japanese patent application serial no. 2014-254972 filed on Dec. 17, 2014, the content of which is hereby incorporated by reference into this application.

FIELD OF THE INVENTION

The present invention relates to structures of steam turbine rotors, and particularly to a steam turbine rotor of which a rotor shaft is made of a conventional heat resistant ferritic steel but that can withstand high main steam temperatures. The invention also particularly relates to a steam turbine including the invention's steam turbine rotor, and a thermal power plant using the invention's steam turbine.

DESCRIPTION OF RELATED ART

Because of the recent trend toward the conservation of energies (such as fossil fuel energy) and the global warming prevention (such as suppression of $CO_2$ gas emission), a demand exists to increase the efficiencies of thermal power plants (such as steam turbines). An effective measure to improve the efficiency of steam turbines is to increase the main steam temperature. As used herein, the term "a 600° C.-class (650° C.-class or 700° C.-class) steam turbine (or thermal power plant)" refers to "a steam turbine (or thermal power plant) operated at a main steam temperature of 600° C. (650° C. or 700° C.)". For example, in current state-of-art ultra-super critical (USC) power plants, the thermal efficiency is expected to be considerably increased by raising the main steam temperature from 600° C.-class (about 600 to 620° C.) to 650° C.-class (about 650 to 670° C.).

Various heat-resistant steels are used for the steam turbine components (such as a rotor) of 600° C.-class USC power plants. Examples of such heat-resistant steels are a heat resistant ferritic steel disclosed in JP Hei 8 (1996)-030251 B2 and a heat resistant austenitic steel disclosed in JP Hei 8 (1996)-013102 A. In order to operate 650° C.-class steam turbines, the components of the steam turbine need to have a sufficient mechanical strength (such as creep strength) at 650° C.

In addition, 700° C.-class advanced ultra-super critical (A-USC) power plants having higher efficiencies than 600° C.-class USC power plants are now being attempted to be developed worldwide. As the steam turbine component materials used for 700° C.-class A-USC power plants, nickel-based superalloys having better high-temperature mechanical strength than heat-resistant steels have been developed. For example, JP Hei 7 (1995)-150277 A discloses such a nickel-based superalloy.

In spite of the growing worldwide responsibility towards global environment conservation, the world's energy demand is continuing to rise. In order to meet both of these conflicting demands, there is a strong need to further increase the efficiency of thermal power plants (in particular steam turbines). As already described, increasing the main steam temperature of steam turbines is very effective to increase the efficiency of the steam turbine.

700° C.-class A-USC steam turbines have been long pursued, but are not yet put into practical use. Instead, as an intermediate target, 650° C.-class thermal power plants are now being attempted into practical use.

When a nickel based superalloy (that withstands 700° C.-class main steam temperatures) is used for thermal power plants, a problem is that the high-cost of the nickel based superalloy may offset the economic advantage (the efficiency increase) of the thermal power plant. As for a rotor shaft made of a heat resistant ferritic steel, a problem is that the high-temperature mechanical strength thereof cannot be adequately obtained above 620° C. when taking centrifugal force acting on the rotor shaft into consideration, and it is not easy to increase the high-temperature mechanical strength to 650° C.-class in heat resistant ferritic steels by any usual method (such as steel composition optimization).

Generally, heat resistant ferritic/austenitic steels have the following advantage and disadvantage: Heat resistant ferritic steels have an advantage of excellent long-term stability and reliability because the dislocation density in the matrix crystal grains is relatively low, and therefore, the microstructure change is relatively small even in long term, high temperature environments. However, ferritic steels have a disadvantage of relatively low high-temperature mechanical strength. Heat resistant austenitic steels have an advantage of excellent high-temperature mechanical strength and oxidation resistance. However, the austenitic steels have a disadvantage of poor long-term stability and reliability because the thermal expansion coefficient is relatively large, and therefore, temperature change cycle is prone to cause thermal fatigue.

SUMMARY OF THE INVENTION

In view of the foregoing, it is an objective of the present invention to provide a steam turbine rotor of which a rotor shaft is made of a low-cost heat resistant ferritic steel and that can withstand high main steam temperatures of about 650° C. Another objective is to provide a steam turbine including the invention's steam turbine rotor, and a thermal power plant using the invention's steam turbine.

(I) According to one aspect of the present invention, there is provided a steam turbine rotor comprising:

a rotor shaft made of a heat resistant ferritic steel; and a rotor blade made of a titanium-aluminum alloy, wherein the titanium-aluminum alloy includes: from 38 to 45 atomic % of aluminum (Al); from 0.5 to 2 atomic % of vanadium (V); from 2 to 6 atomic % of chromium (Cr) and/or molybdenum (Mo); and the balance being titanium (Ti) and incidental impurities.

In the above steam turbine rotor (I), the following modifications and changes can be made.

(i) The heat resistant ferritic steel is a 12-Cr steel; and the titanium-aluminum alloy further includes: one or more of niobium (Nb), tantalum (Ta), tungsten (W), iron (Fe), manganese (Mn) and nickel (Ni) in a total amount from 0.5 to 3 atomic %; and/or from 0.05 to 0.2 atomic % of boron (B).

(ii) The titanium-aluminum alloy of the rotor blade has a forged microstructure.

(II) According to another aspect of the present invention, there is provided a steam turbine including a high pressure stage including the above steam turbine rotor.

(III) According to still another aspect of the present invention, there is provided a thermal power plant including the above steam turbine.

(Advantages of the Invention)

According to the present invention, it is possible to provide a steam turbine rotor of which a rotor shaft is made of a conventional low-cost heat resistant ferritic steel and that can withstand high main steam temperatures of about 650° C. Also possible is to provide, by using the invention's steam turbine rotor, a steam turbine that can withstand high main steam temperatures of about 650° C. Further possible is to provide, by using the invention's steam turbine, a low-cost, high-efficiency thermal power plant.

DETAILED DESCRIPTION OF THE PREFERRED EMBODIMENTS (Basic Idea of the Present Invention)

As already described, in heat resistant ferritic steels, the dislocation density in the matrix crystal grains is relatively low, and therefore, the microstructure change is relatively small even in long term, high temperature environments. Thus, heat resistant ferritic steels have advantages of long-term stability and reliability. However, these ferritic steels have a disadvantage of relatively low mechanical strength. The present invention is directed to use of a conventional cheap heat resistant ferritic steel as a material of the rotor shafts of steam turbine rotors.

Figure 1:
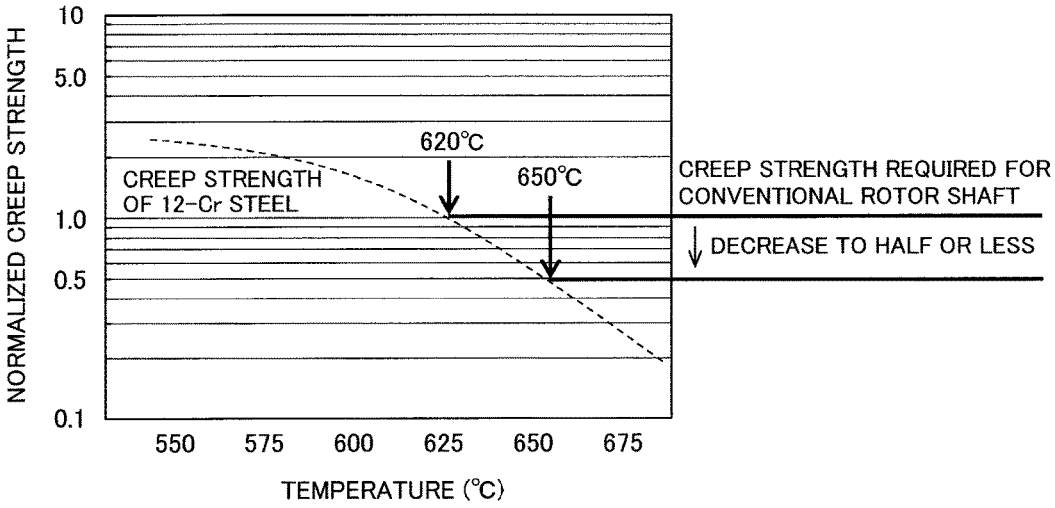
FIG. 1 is a graph showing a relationship, for 12-Cr steel, between temperature and normalized creep strength.

The present inventors have investigated the centrifugal force acting on a rotor shaft made of a heat resistant ferritic steel. FIG. 1 is a graph showing a relationship, for 12-Cr steel, between temperature and normalized creep strength. Herein, the creep strength at 620° C. that is required for 600° C.-class steam turbine rotor shafts is set as a reference of the normalized creep strength.

As shown in FIG. 1, the creep strength of 12-Cr steel decreases with increasing temperature, and the decreasing rate increases with increasing temperature. More specifically, the creep strength of 12-Cr steel roughly halves when the temperature increases by 30° C. from 620° C. to 650° C.

The centrifugal force acting on a rotor shaft is mainly caused by the rotation of the rotor blades on the shaft, where the centrifugal force acting on each blade is proportional to "the length of the rotor blade×the mass of the rotor blade× (the rotor angular velocity)$^2$". Herein, if the blade length or the rotor rotational rate is reduced, the rotor torque (i.e. the turbine output) drops, which is unacceptable. However, the centrifugal force acting on the rotor shaft can also be halved by halving the mass of the rotor blades. In this case, the rotor torque (turbine output) is sacrificed. To summarize, even when the creep strength of the rotor shaft is low, such reduction in the creep strength can be compensated by the centrifugal force reduction resulting from the blade mass reduction, without sacrificing the turbine output.

In view of the above discussion, the present inventors have intensively investigated materials having a density (specific weight) half of heat resistant steels and having properties required for steam turbine blades (such as high-temperature mechanical strength and high-temperature oxidation resistance). After the investigation, the following result was obtained: By forming rotor blades from a Ti—Al alloy having a specified composition, the centrifugal force acting on the rotor shaft can be reduced, thereby compensating for a reduction in the rotor shaft creep strength. The present invention is based on this new finding.

Preferred embodiments of the invention will be described below with reference to the accompanying drawings. The invention is not limited to the specific embodiments described below, but various combinations and modifications are possible without departing from the spirit and scope of the invention.

The present invention is directed to forming steam turbine rotor shafts from a conventional cheap heat resistant ferritic steel. In order to increase the main steam temperature of a steam turbine to 650° C.-class, the high temperature resistance of the rotor shaft needs to be increased. For this purpose, the relatively low creep strength of the ferritic steel of the rotor shaft needs to be compensated by reducing the centrifugal force acting on the rotor shaft. In order to achieve this objective, it is preferable to form the rotor blades from a light-weight and high strength-to-weight ratio Ti—Al alloy.

(Steam Turbine Rotor Blade)

The rotor blades of a steam turbine require a high fracture toughness because oxide scales peeling off the boiler impinge onto the rotor blades. The rotor blades also require a high steam oxidation resistance in addition to an excellent high-temperature mechanical strength. In view of the above requirements, the Ti—Al alloy for rotor blades in the invention preferably contains; from 38 to 45 atomic % of Al; from 0.5 to 2 atomic % of V; from 2 to 6 atomic % of Cr and/or Mo; and the balance being Ti and incidental impurities. In order to improve the mechanical strength, the Ti—Al alloy in the invention may further contain one or more of Nb, Ta, W, Fe, Mn and Ni in a total amount from 0.5 to 3 atomic %. Also, the Ti—Al alloy in the invention may further contain from 0.05 to 0.2 atomic % of B in order to decrease (refine) the grain size. Meanwhile, the B may be added in the form of titanium diboride ($TiB_2$).

There is no particular limitation on the method of forming a rotor blade from the Ti—Al alloy in the invention, but any conventional method may be used (e.g., forging or precision casting). In the case of forging, an ingot of the Ti—Al alloy is first heated to and maintained at 900 to 1200° C., then closed die forged, next heat treated (for microstructure optimization), and finally mechanically surface finished (such as cutting and grinding). In this way, steam turbine rotor blades having a forged microstructure can be formed from the Ti—Al alloy. Alternatively, steam turbine rotor blades may be formed by mechanically or electrical spark machining a forged block of the Ti—Al alloy.

In the case of precision casting, after a precision casting (such as lost-wax process and centrifugal casting), a hot isostatic pressing (HIP) is preferably performed in order to eliminate casting defects (such as shrinkage cavities). For example, the HIP is performed by holding a cast article in an inert gas (such as argon) at 1100 to 1300° C. and 150 to 250 MPa for 2 to 6 hours. After the HIP treatment, a heat treatment (for microstructure optimization) and a mechanical surface finishing (such as cutting and grinding) are performed. In this way, a steam turbine rotor blade having a cast microstructure can be formed from the Ti—Al alloy. In the above precision casting process, the HIP is not necessarily needed, but may be performed as needed.

Figure 2:
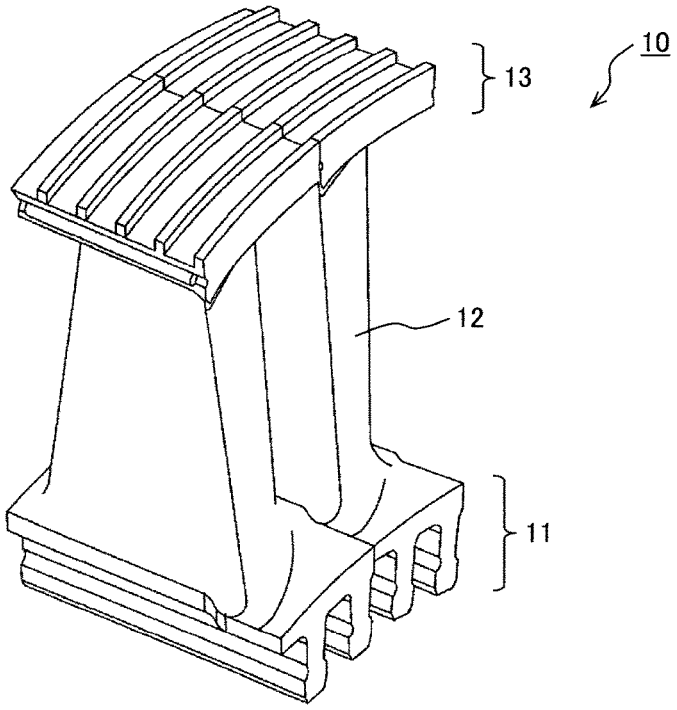
FIG. 2 is a schematic illustration showing a perspective view of an example of a steam turbine rotor blade (a control stage rotor blade)

FIG. 2 is a schematic illustration showing a perspective view of an example of a steam turbine rotor blade (a control stage rotor blade). As illustrated in FIG. 2, a rotor blade 10 is of axial entry type. The rotor blade 10 includes a blade root section 11, a blade profile section 12 and a blade cover section 13. The blade cover section 13 is larger than the blade profile section 12. Therefore, when these two sections are integrally formed, excess thickness may be produced, leading to cost increase. In order to mitigate this cost problem, the blade cover section 13 and the blade profile section 12 may be separately formed and then joined by, for example, friction stir welding.

In order to improve the steam oxidation resistance of the rotor blade 10, a passivation film is preferably coated on a surface of the rotor blade 10 (in particular, the surface of the blade profile section 12). Examples of the passivation film are: a flame sprayed coating of a Co based alloy (such as a Co—Ni—Cr—Al—Y alloy and stellite (registered trademark)); and an aluminum oxide (alumina) passivation film.

(Steam Turbine Rotor Shaft)

As already described, the present invention is directed to forming steam turbine rotor shafts from a conventional cheap heat resistant ferritic steel. The ferritic steel for forming steam turbine rotor shafts in the invention preferably has as high a creep strength at 650° C. as possible; for example, a 12-Cr steel is preferable. For example, the 12-Cr steel contains: from 0.05 to 0.30 mass % of carbon (C); 0.2 or less mass % of silicon (Si); from 0.01 to 1.5 mass % of manganese (Mn); from 0.005 to 0.3 mass % of nickel (Ni); from 8.5 to 11.0 mass % of chromium (Cr); from 0.05 to 0.5 mass % of molybdenum (Mo); from 1.0 to 3.0 mass % of tungsten (W); from 0.05 to 0.30 mass % of vanadium (V); from 0.01 to 0.20 mass % of niobium (Nb); from 0.5 to 2.5 mass % of cobalt (Co); from 0.01 to 1.0 mass % of rhenium (Re); from 0.01 to 0.1 mass % of nitrogen (N); from 0.001 to 0.030 mass % of boron (B); from 0.0005 to 0.006 mass % of aluminum (Al); and the balance being iron (Fe) and incidental impurities.

(Steam Turbine Rotor)

For realization of 650° C.-class steam turbines, there are, for example, the following component material configuration options: 1) The rotor shaft and blades are both made of an Ni based superalloy. 2) The rotor shaft and blades are respectively made of an Ni based superalloy and a heat-resistant steel. 3) The rotor shaft and blades are respectively made of a heat resistant ferritic steel and a Ti—Al alloy. The first configuration leads to very high cost compared with 600° C.-class steam turbine rotors since the rotor shaft and blades are both made of an expensive Ni based superalloy. The second configuration is also rather expensive since the rotor shaft is made of an expensive Ni based superalloy instead of a cheap steel used in 600° C.-class steam turbine rotors. The third configuration is according to the invention. However, this configuration is also expensive by the amount that the rotor blades are made of a high-cost Ti—Al alloy instead of a cheap steel used in 600° C.-class steam turbine rotors.

Herein, the shaft of a steam turbine rotor generally occupies a large portion of the weight, volume and therefore cost of the rotor. In this view, the third configuration is less expensive than the second because a cheap material is used for the large portion of the rotor (i.e. the shaft) in the third configuration. A calculation shows that the total cost of the third configuration can be suppressed to about half of the second one. Thus, the steam turbine rotor of the invention contributes to a cost reduction of 650° C.-class steam turbines.

(Steam Turbine)

Figure 3:
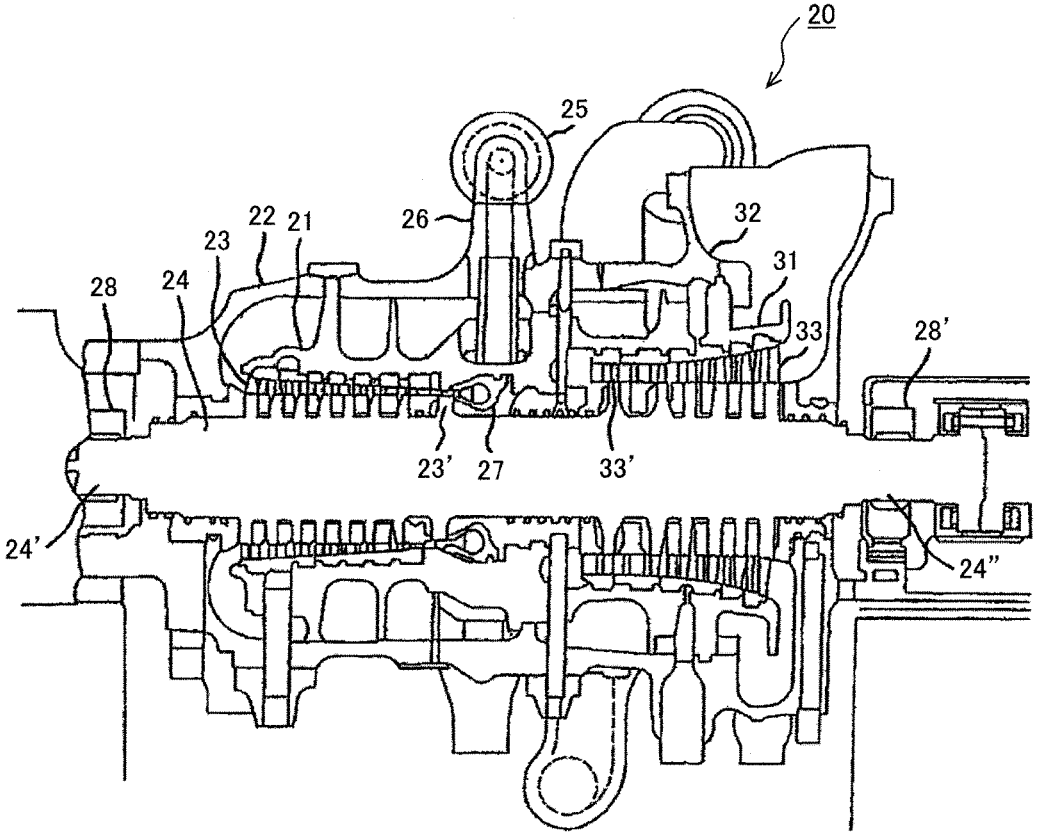
FIG. 3 is a schematic illustration showing a longitudinal sectional view of an example of a steam turbine according to the invention.

FIG. 3 is a schematic illustration showing a longitudinal sectional view of an example of a steam turbine according to the invention. The steam turbine 20 in FIG. 3 is of a combined high/medium pressure stage type, in which a high pressure stage steam turbine and a medium stage steam turbine are combined. The high pressure stage steam turbine (the left half of the figure) includes: a high pressure inner turbine casing 21, a high pressure outer turbine casing 22; and a combined high/medium pressure stage rotor shaft 24 within these inner/outer turbine casings. High pressure stage rotor blades 23 are implanted in the rotor shaft 24. A high-temperature, high-pressure steam is produced at a boiler (not shown), and is introduced into a high pressure-stage first blade 23' through a main steam pipe (not shown), a flange elbow 25, a main steam inlet 26, and a nozzle box 27. The steam flows from a middle of the combined high/medium pressure stage rotor shaft toward a bearing portion of the rotor shaft 24' and a rotor bearing 28 on the side of the high pressure stage steam turbine. As aforementioned, the invention is directed to operating this steam turbine at a main steam temperature of 650° C.

The steam exiting the high pressure stage steam turbine is reheated at a reheater (not shown) and then introduced into the medium pressure stage steam turbine (the right half of the figure). The medium pressure stage steam turbine, cooperating with the high pressure stage steam turbine, rotates an electric generator (not shown). Similarly to the high pressure stage steam turbine, the medium pressure stage steam turbine includes: a medium pressure inner turbine casing 31, a medium pressure outer turbine casing 32; and the combined high/medium pressure stage rotor shaft 24 within these medium pressure inner/outer turbine casings. Medium pressure stage rotor blades 33 are implanted in the rotor shaft 24. The reheated steam enters from a middle of the combined high/medium pressure stage rotor shaft and flows by being led by medium pressure-stage first blades 33' toward a bearing portion of the rotor shaft 24" and a rotor bearing 28' on the side of the medium pressure stage steam turbine.

(Thermal Power Plant)

Figure 4:
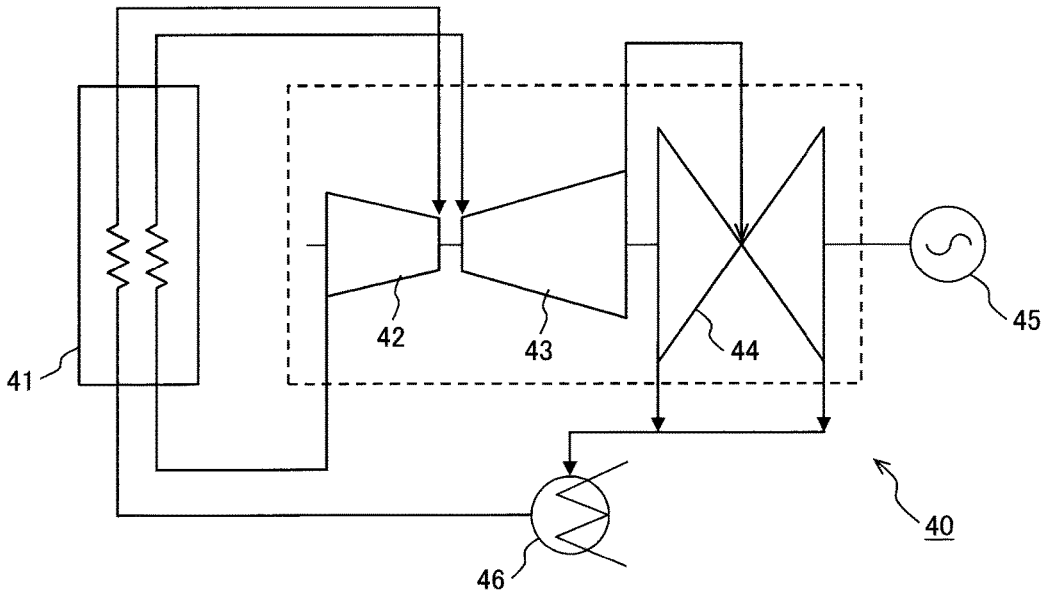
FIG. 4 is a system diagram of an example of a thermal power plant according to the invention.

FIG. 4 is a system diagram of an example of a thermal power plant according to the invention, where the high pressure stage steam turbine and the medium pressure stage steam turbine are separate and tandem connected by the rotor shaft with each other. As shown in the thermal power plant 40 of FIG. 4, a high-temperature, high-pressure steam produced at a boiler 41 does work at the high pressure stage steam turbine 42 and then reheated at the boiler 41. Next, the reheated steam does work at the medium pressure stage steam turbine 43 and then further does work at a low pressure stage steam turbine 44. The work done by these steam turbines are converted into electricity at an electric generator 45. The exhaust steam exiting the low pressure stage steam turbine 44 is delivered to a condenser 46 (where the steam is condensed to water), and then returned to the boiler 41.

EXAMPLES

The invention will be described below more specifically by way of examples. However, the invention is not limited to the specific examples below.

An experimental steam turbine rotor was fabricated according to the invention, which was tested for the power generation performance and long-term reliability at a main steam temperature of 650° C. on a test apparatus.

The Ti—Al alloy used to fabricate the experimental turbine rotor blades contains; 44.5 atomic % of Al; 1.0 atomic % of V; 4.0 atomic % of Mo; 0.1 atomic % of B; and the balance being Ti and unintended impurities. The density of this Ti—Al alloy is about 4.0 g/cm$^3$, which is about half those of conventional 12-Cr steels. When a rotor blade is formed from this Ti—Al alloy, the mass can be about halved compared to a conventional steel rotor blade, thereby halving the centrifugal force acting on the rotor shaft.

The experimental turbine rotor blade was fabricated as follows: First, a billet made of the Ti—Al alloy was prepared and then the experimental steam turbine rotor blade was formed by closed die forging the billet. Next, the forged rotor blade was heat treated for microstructure optimization, and finally the entire surface of the rotor blade was mechanically finished to complete the fabrication of the experimental turbine rotor blade shown in FIG. 2. In this example, the experimental turbine rotor blade was not subjected to any anti-steam oxidation coating.

Then, a plurality of the experimental turbine rotor blades were implanted in a rotor shaft made of a 12-Cr steel to form an experimental high pressure stage steam turbine rotor as shown in FIG. 3, which was tested on the test apparatus.

The experimental high pressure stage steam turbine rotor was run in actual operation mode (main steam temperature of 650° C.; operating time of 10,000 hours) and the transmission end efficiency was measured. The transmission end efficiency of the experimental steam turbine according to the invention was increased by 1.0% as a result of the increase in the main steam temperature from 620° C. to 650° C.

After the actual operation test, the experimental steam turbine rotor was removed and conditions of the rotor blades and the rotor shaft were examined. The result was that the amount of oxide scales on the Ti—Al alloy rotor blades was very small (an unproblematic level). Also, there were not any unusual problems in the 12-Cr steel rotor shaft. This result demonstrates that the steam turbine rotor of the invention has a sufficient long-term reliability.

The invention is not limited to the above described embodiments, and various modifications can be made. Also, the above embodiments are given for the purpose of detailed illustration and explanation only, and the invention is not intended to include all features and aspects of the embodiments described above. Also, a part of an embodiment may be replaced by one or more parts of the other embodiments, or added with one or more parts of the other embodiments. Also, a part of an embodiment may be removed, or replaced by one or more parts of the other embodiments, or added with one or more parts of the other embodiments.

What is claimed is:

1. A steam turbine rotor to be used for steam having a temperature of about 650 to 670° C. comprising:

a rotor shaft made of a heat resistant ferritic steel of a 12-Cr steel; and a blade made of a titanium-aluminum alloy, wherein the titanium-aluminum alloy includes: from 38 to 44.5 atomic % of aluminum; from 0.5 to 2 atomic % of vanadium; one of or both of chromium and molybdenum in a total amount from 2 to 6 atomic %; and the balance being titanium and incidental impurities, wherein the titanium-aluminum alloy may optionally further include: one or more of niobium, tantalum, tungsten, iron, manganese and nickel in a total amount from 0.5 to 3 atomic %; and/or from 0.05 to 0.2 atomic % of boron, and wherein the 12-Cr steel consists of: from 0.05 to 0.30 mass % of carbon; 0.2 or less mass % of silicon; from 0.01 to 1.5 mass % of manganese; from 0.005 to 0.3 mass % of nickel; from 8.5 to 11.0 mass % of chromium; from 0.05 to 0.5 mass % of molybdenum; from 1.0 to 3.0 mass % of tungsten; from 0.05 to 0.30 mass % of vanadium; from 0.01 to 0.20 mass % of niobium; from 0.5 to 2.5 mass % of cobalt; from 0.01 to 1.0 mass % of rhenium; from 0.01 to 0.1 mass % of nitrogen; from 0.001 to 0.030 mass % of boron; from 0.0005 to 0.006 mass % of aluminum; and the balance being iron and incidental impurities.

2. The steam turbine rotor according to claim 1, wherein the titanium-aluminum alloy of the blade has a forged microstructure.

3. A steam turbine, comprising a high pressure stage including the steam turbine rotor according to claim 1.

4. A steam turbine, comprising a high pressure stage including the steam turbine rotor according to claim 2.

5. A thermal power plant, comprising the steam turbine according to claim 3.

6. The steam turbine rotor according to claim 1, wherein a passivation film for steam oxidation resistance is coated on a surface of the blade.

* * * * *